US009504327B2

(12) United States Patent
Ledat

(10) Patent No.: US 9,504,327 B2
(45) Date of Patent: Nov. 29, 2016

(54) RECLINABLE CHAIR HAVING A LOCKING GAS SPRING RECLINING BACK REST

(71) Applicant: Harmony Lifestyle, LLC, West Palm Beach, FL (US)

(72) Inventor: Tony Ledat, West Palm Beach, FL (US)

(73) Assignee: Harmony Lifestyle, LLC, West Palm Beach, FL (US)

( * ) Notice: Subject to any disclaimer, the term of this patent is extended or adjusted under 35 U.S.C. 154(b) by 0 days.

(21) Appl. No.: 14/617,077

(22) Filed: Feb. 9, 2015

(65) Prior Publication Data

US 2016/0227931 A1 Aug. 11, 2016

(51) Int. Cl.

| | |
|---|---|
| ***A47C 1/024*** | (2006.01) |
| ***A47C 3/30*** | (2006.01) |
| ***A47C 7/38*** | (2006.01) |
| ***A47C 7/44*** | (2006.01) |
| ***A47C 7/00*** | (2006.01) |

(52) U.S. Cl.

CPC ..... *A47C 1/0244* (2013.01); *A47C 3/30* (2013.01); *A47C 7/006* (2013.01); *A47C 7/38* (2013.01); *A47C 7/446* (2013.01)

(58) Field of Classification Search

CPC ..... A47C 1/0244
USPC ..... 297/356, 301.2, 391
See application file for complete search history.

(56) References Cited

U.S. PATENT DOCUMENTS 4,589,697 A * 5/1986 Bauer ..... A47C 1/0244 297/301.2
4,703,974 A * 11/1987 Brauning ..... A47C 7/004 248/188.7
4,707,029 A * 11/1987 Korn ..... A47C 3/026 267/177
4,813,743 A * 3/1989 Mizelle ..... A47C 1/034 297/301.2
5,069,496 A * 12/1991 Kunh ..... A47C 1/0246 267/158
5,385,388 A * 1/1995 Faiks ..... A47C 1/03255 297/284.4
5,419,615 A * 5/1995 Dozsa-Farkas .... A47C 1/03255 297/301.2
6,739,664 B2 * 5/2004 Kinoshita ..... A47C 1/03255 297/300.3
7,497,515 B2 * 3/2009 Krehm ..... A47C 473/026 297/300.3
2005/0280300 A1 * 12/2005 Tin ..... A47C 1/03283 297/300.3
2009/0315376 A1 * 12/2009 Nishiwaki ..... A61G 5/006 297/301.2
2012/0139321 A1 * 6/2012 Wu ..... A47C 7/38 297/391

FOREIGN PATENT DOCUMENTS

| | | | |
|---|---|---|---|
| DE | EP 0179933 | * | 5/1986 |
| FR | EP 0240389 | * | 10/1987 |

* cited by examiner

*Primary Examiner* — Timothy J Brindley
(74) *Attorney, Agent, or Firm* — McHale & Slavin, P.A.

(57) ABSTRACT

A reclining chair having a seat, base frame, and a back rest movably connected to the base frame. The base frame includes at least a three prong base attached to caster wheels and a column, the seat is connected to the column of the base frame and includes a front end and back end. The back rest has top portion, intermediate portion, and bottom portion, the intermediate portion is hingedly connected to the back end of the seat and the bottom portion is movably connected to the base frame, using a lockable gas spring. The lockable gas spring has a first end connected to the bottom portion of the back rest and a second end connected to the base frame, whereby the movable distance between the first end and the second of the gas cylinder moves the back rest between an upright position and a reclined position.

11 Claims, 6 Drawing Sheets

RECLINABLE CHAIR HAVING A LOCKING GAS SPRING RECLINING BACK REST

FIELD OF THE INVENTION

This invention relates generally to a reclinable chair, in particular a locking gas spring reclinable chair which is positionable anywhere from a fully upright to substantially horizontal position.

BACKGROUND OF THE INVENTION

A "recliner" is a chair the back of which can be adjusted to allow the person seated therein to rotate the back portion of the chair while raising the front of the chair. A foot rest is typically extended by the use of a lever or automatically upon rotation of the back rest. A recliner is generally considered a large difficult piece of furniture to move and is typically placed in a den or family room, rather than used as office furniture. However, it has become common for employees to spend extended periods of time in the office. Thus, there is a need to provide chairs which comfortably accommodate them. Office workers sit for long uninterrupted periods of time in the same chair, shifting their weight forward or backwards or from side to side for comfort and to alleviate the pressure applied to the hips and lower back. To help alleviate the pressure applied to the hips and lower back caused by long-term and uninterrupted seating it is preferable to provide a chair whose back support may be tilted between an upright and reclined position allowing the user to effectively seek the most comfortable/desirable seating arrangement.

There are a variety of office chairs available on the market, many of which have tilt control mechanisms. The purpose of the design is to provide a comfortable and ergonomic seating arrangement for the user that allows him or her to sit in a variety of positions while providing the necessary support and comfort, regardless of the user's height, weight or other physical characteristics. Generally, an office chair has a base, typically mounted on casters or fixed slides that rest on the floor, with a support column supporting the seat of the chair located thereon. The chair may or may not include armrests. Mounted to the support column and between the seat and back of the chair is a tilt control housing which contains the various controls, knobs, and mechanisms for adjusting the height of the chair, the tilt of the chair and other various adjustments so that the user can personalize the chair to his or her own use.

There are many mechanisms for controlling the tilt of an office chair. The inclination of the back, and the seat portion is generally accomplished by means of snap detent elements or differential-type gears. Because the arms of most office chairs are used to position and support the back of the chair, these structures are generally unsatisfactory requiring the entire seat to tilt causing the front of the seat to rise as the back is tilted. This arrangement often places pressure under the rear portion of the user's legs near the knees restricting circulation and often causing numbness. Most of these constructions are operated by a spring that is connected between plates positioned under the base of the seat and activated by a lever that releases a catch from one of the plates that allows tilting of the entire chair including the seat and the backrest. While the spring can be of various types of construction, such as leaf spring, coil spring, or the like, the tilt of the chair is generally controlled by the user's weight pressing on the back portion of the chair. The chair is generally biased toward an upright position at all times such that the user must exert pressure to maintain the seat in a tilted position. While the amount and ease of tilt may be controlled by adjusting the spring tension, as soon as the user moves forward towards an upright position, the backrest also moves forward thus pushing against his or her back. Thus, requiring the user to constantly regulate the tilt of the chair with their legs. In addition, because the arms of the chair are used to support the back, this arrangement fails to allow the back to be reclined separately from the seat portion of the chair.

Accordingly, there exists a need in the art for an alternative office chair that provides the ability to recline the back of the chair separately from the seat portion of the chair. The reclinable office chair should utilize a locking gas spring which provides infinite positionability between a fully upright position and reclined positions. The use of the lockable gas cylinder should allow for elimination of the typical pin and aperture locking mechanisms of the prior art.

SUMMARY OF THE INVENTION

The present invention relates to a reclining chair having a seat, base frame, and a back rest movably connected to the base frame. The base frame includes at least a three prong base attached to caster wheels and a column. The seat is connected to the column of the base frame and includes a front end and back end. The back rest has a top portion, intermediate portion, and bottom portion, the intermediate portion being hingedly connected to the back end of the seat and the bottom portion pivotably connected to the base frame, using a reclining mechanism. The back rest can be adjusted between an upright position and a reclined position by means of a reclining mechanism, which is defined by a lockable gas spring having a first end that is connected to the base frame and a second end connected to a bottom portion of the back rest. The distance between the first and second ends of the gas spring may be increased or decreased by moving the back rest between upright and reclined positions. In at least some embodiments, the gas spring is lockable whereby an internal mechanism within the gas spring provides the ability to lock the chair back in a desired position. In still other embodiments, the gas spring may be elastic in one direction while locking in the opposite direction. This embodiment provides a back that can be reclined to a desired angle and provide elasticity when subjected to pressure without defaulting to the full upright position even if all pressure is removed from the chair back.

Accordingly, it is an objective of the present invention to provide an office chair having a reclining back mechanism that includes a gas spring providing an infinite number of reclined positions to the chair back.

It is a further objective of the present invention to provide an office chair having a reclining back mechanism that includes a locking gas spring providing an infinite number of reclined positions to the chair back.

It is yet another objective of the present invention to provide an office chair having a reclining back mechanism that includes an elastic locking gas spring providing an infinite number of reclined positions to the chair back.

It is yet a further objective of the invention to provide an office chair with a reclining mechanism that is reliable, simple, and effective as a result of having minimal moving parts that comprise the reclining mechanism.

It is still an objective of the invention to provide an office chair having a back panel not supported and positioned by armrests connected to the seat panel.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
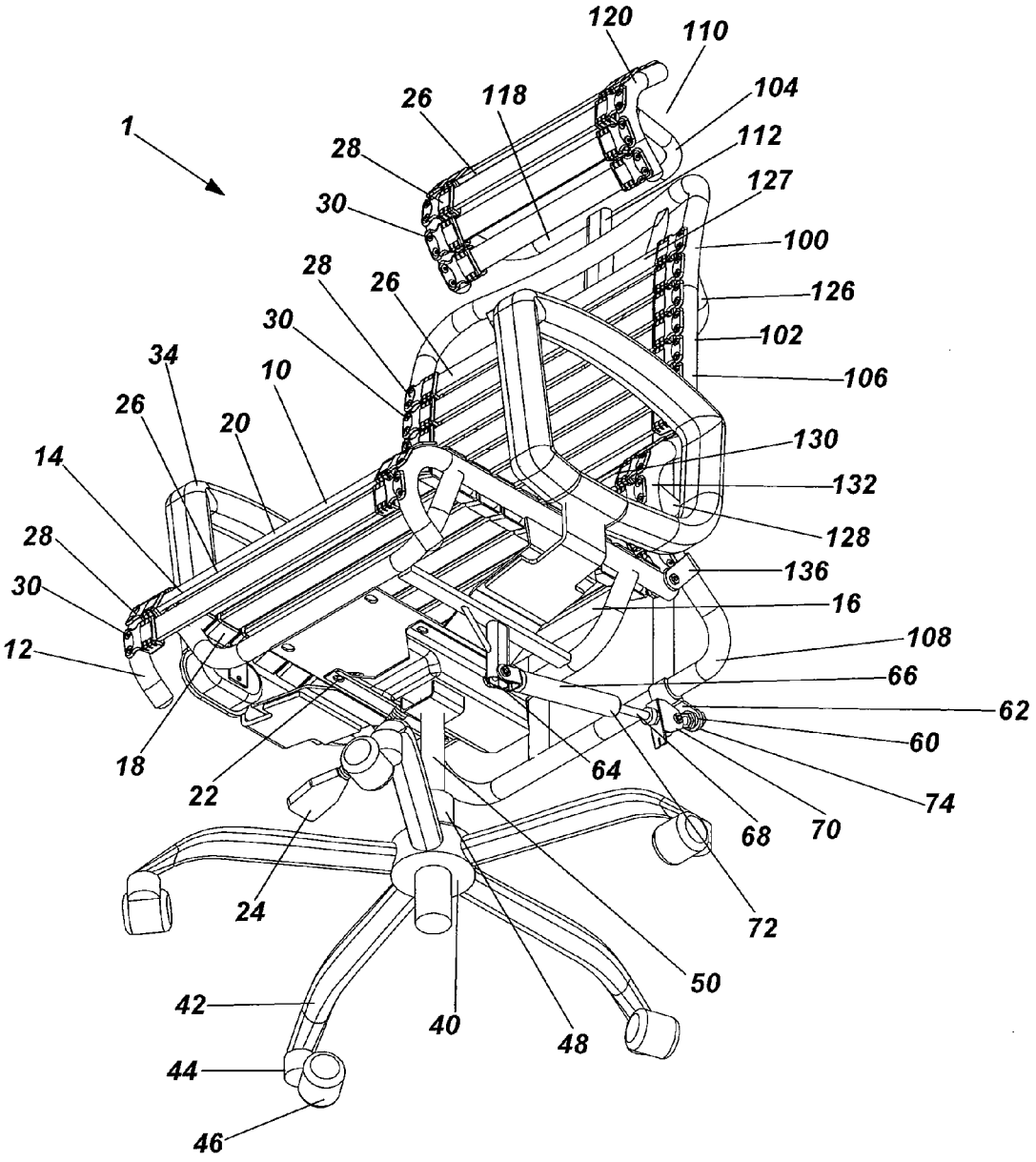
FIG. 1 is a perspective view of the reclining chair of the present invention.
Figure 2:
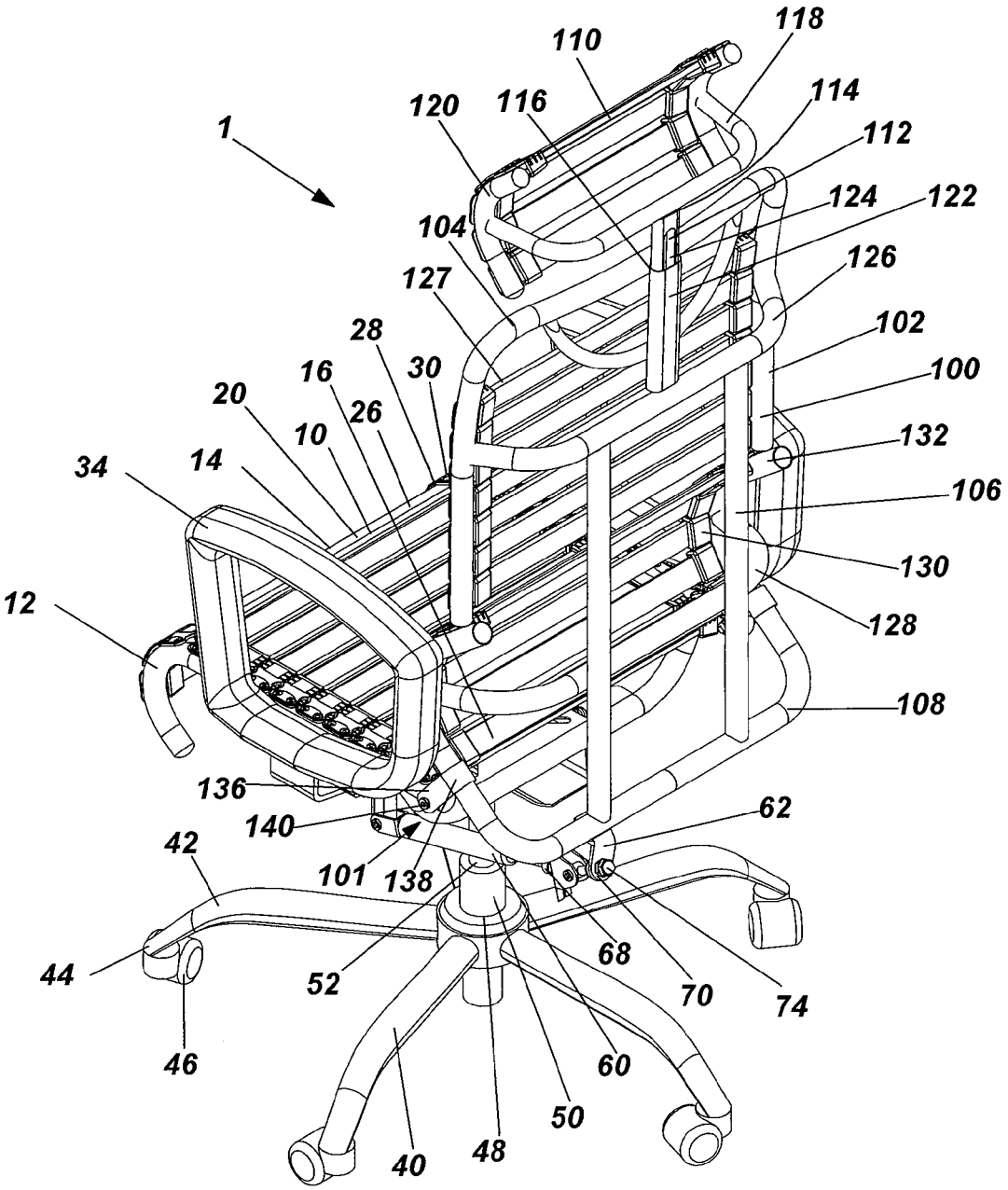
FIG. 2 is an alternative perspective view thereof.
Figure 3:
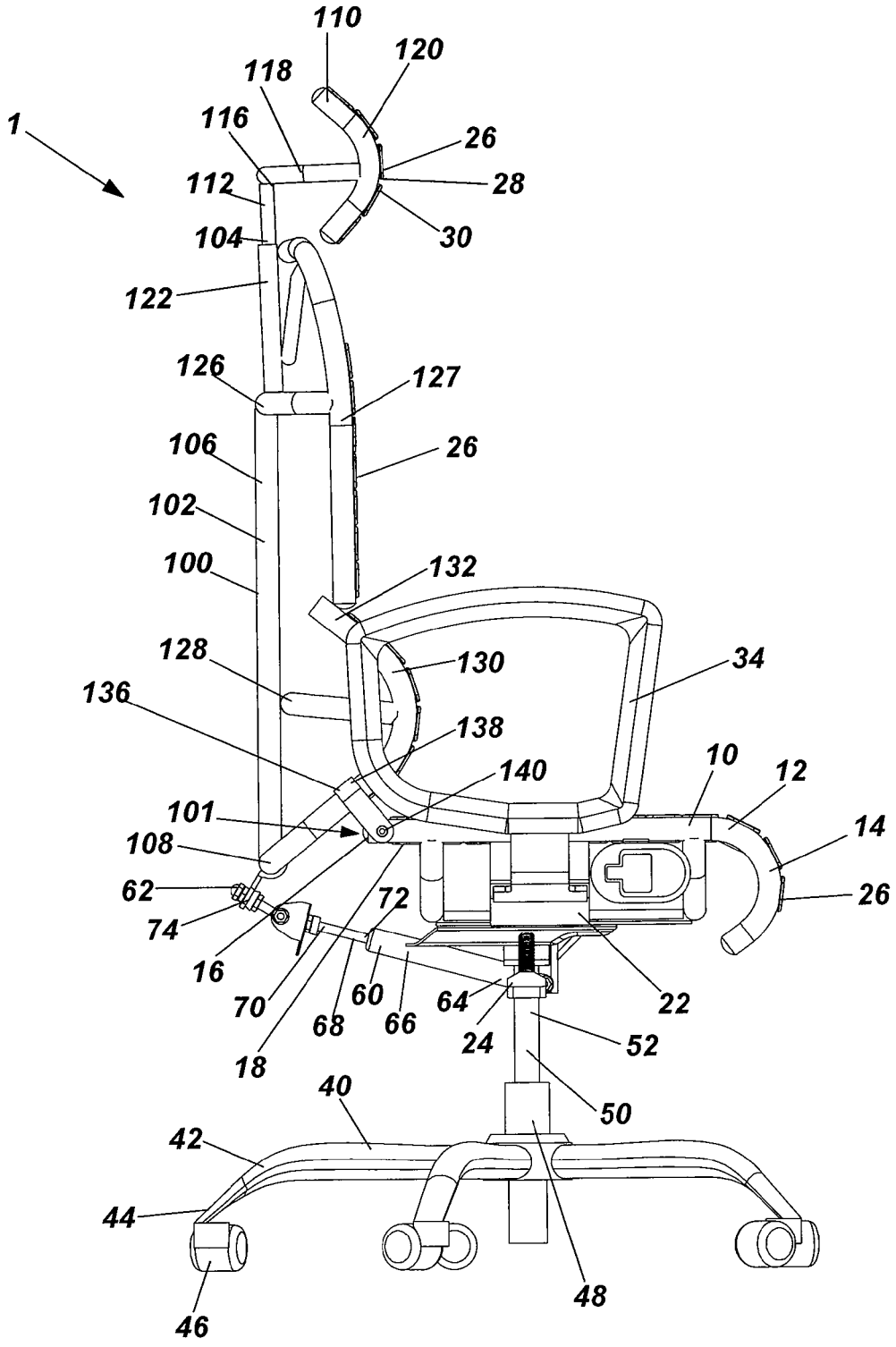
FIG. 3 is a side view thereof.
Figure 4:
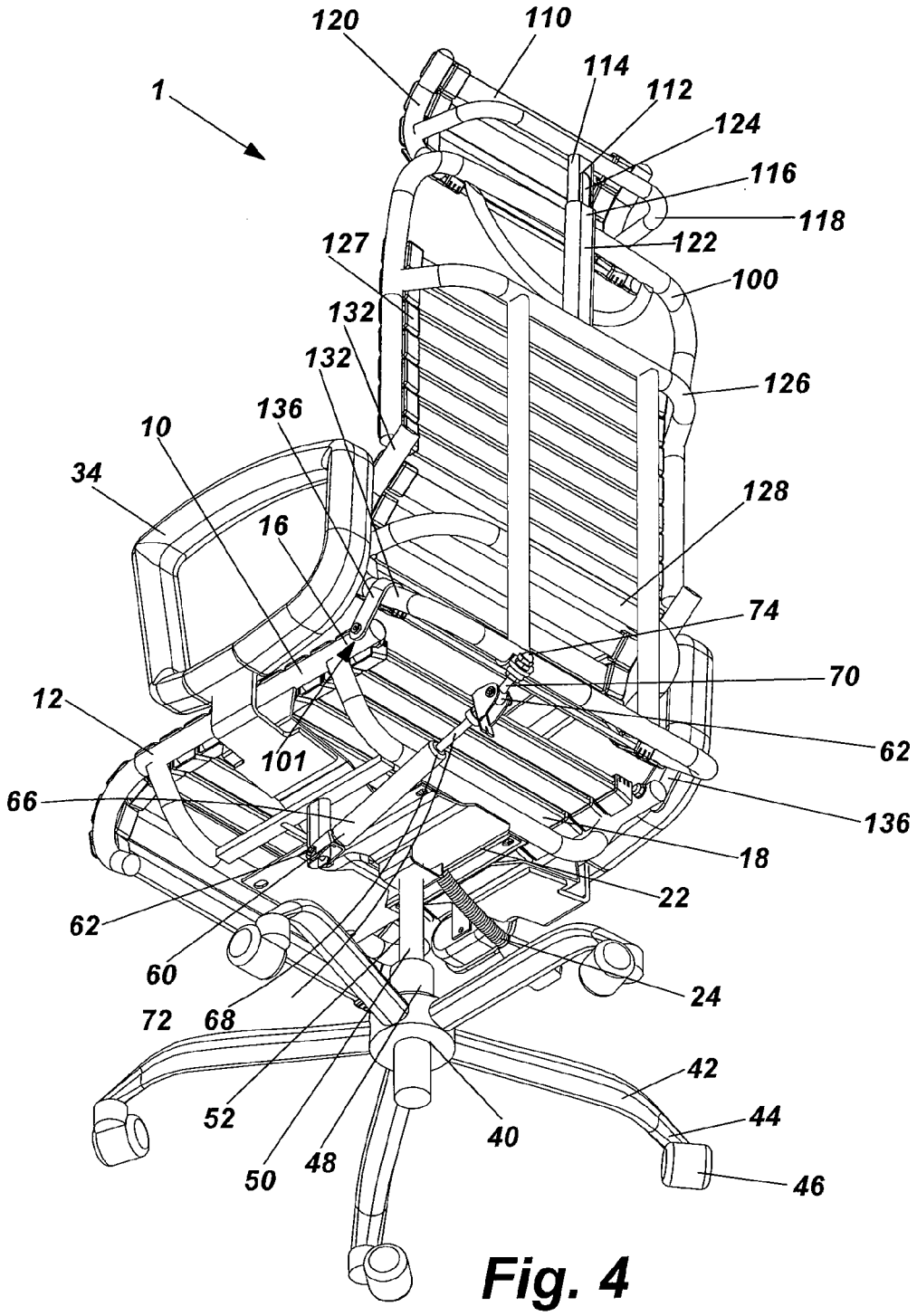
FIG. 4 is a bottom perspective view thereof.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring generally to FIGS. 1-6, in which similar reference characters denote similar elements throughout the several views, an office chair 1 having a reclining back rest 100 is illustrated. The office chair 1 includes a seat 10, base frame 40, and a back rest 100 movably connected to the base frame 40. As shown in FIGS. 1-4, the base frame 40 includes at least a three legged base 42 attached to caster wheels 46 and a column 48. It should be noted that the base 40 is not limited to a three legs and any number of legs can also be utilized without departing from the scope of the invention. In the preferred embodiment, the base frame 40 includes a four legged base 42. On the distal end 44 of each leg is attached a caster wheel 46, enabling the office chair 1 to be easily moved. The caster wheels 46 are contemplated in various sizes, and can be made of rubber, plastic, nylon, aluminum, stainless steel, or the like. Inside the column 48 is inserted a gas lift spring 50. The gas lift spring 50 is inserted into the base an includes a piston shroud 52 to protect the gas spring and provide an aesthetic appearance.

Secured atop of the column 48 is the seat 10. The seat 10 is comprised of a frame 12 having a front end 14, back end 16, underside 18, and top side 20. The underside 18 of the seat 10 has a metal plate 22 that is used to attach the gas lift spring 50 to the seat 10. The metal plate 22 contains levers 24 used to operate the fluid and/or pneumatics within the gas lift spring 50 as is known in the art allowing the gas lift spring to lift the seat up and down. The gas lift spring 50 utilized by the office chair is preferably a locking gas spring which includes a special piston/valve system (not shown). The piston/valve system separates two pressure chambers within the gas spring. If the valve is operated it allows the pressurized gas to flow between the two pressure chambers. Releasing the valve blocks the flow of gas locking the piston in place within the gas spring to hold even heavy loads in the desired position. The volume of compressed gas contained in the cylinder portion of the gas spring can be adjusted to make the spring more or less forceful in its movement. The top side 20 of the seat 10 includes a plurality of parallel members 26. The terminating ends 28 of each parallel member 26 is mounted at fastening locations 30 along the seat frame 12. The plurality of parallel members 26 provides a surface for the user to sit on. Additionally, the top side 20 of the seat frame 12 may include arm rests 34 on opposite sides thereof. It should be noted that in the preferred embodiment the arm rests are exclusively supported by the seat portion of the office chair 1 to allow the back rest 100 to move independently with respect to the seat.

Referring to FIGS. 1-4, the back rest hinge assembly 101 is illustrated. In general, the back rest hinge assembly 101 connects the back end 16 of the seat 10 to the back rest 100. The back rest 100 is comprised of a frame 102 having a top portion 104, intermediate portion 106, and bottom portion 108. The intermediate portion 106 is connected via the back rest hinge assembly 101 to the back end 16 of the seat 10 to allow pivotal movement of the back rest. The bottom portion 108 of the back rest 100 extends downwardly past the horizontal plane of the seat 10 to allow the bottom portion 108 of the back rest to be movably connected to the base frame 40 via a lockable gas spring 60. In this manner, the office chair user can manipulate the lockable gas cylinder to providing infinite positioning of the seat back. The top portion 104 of the frame 102 includes a head rest 110. The head rest 110 is comprised of a vertically movable extension rod 112 having a first end 114 connected to the top portion 104 of the back rest frame 102 and a second end 116 connected to a U-shaped flange 118. The U-shaped flange 118 extends substantially the width of the back rest frame 102 and is connected on opposite ends to a backward C-shaped head piece 120. The vertically movable extension rod 112 allows the user to position the head rest 110 in the most comfortable vertical position according to the user's height and preference for head placement. The vertically movable extension rod 112 is connected to the top portion 104 of the back rest 100 by inserting it within a hollow tube 122, which is located along the center of the frame 102 on the upper U-shaped flange 118 (discussed below), thereby enabling the vertically movable extension rod 112 to be movable within. The vertically movable extension rod 112 can be vertically displaced and positioned using various locking mechanisms 124 such as, but not limited to, a latch, rack and pinion, sliding lock, spring lock, push button, or the like. In the preferred embodiment the reclining chair 1 utilizes a push button locking mechanism 124.

As shown in FIG. 1-6, the intermediate portion 106 of the back rest frame 102 includes a pair of U-shaped flanges, 126 and 128. The upper flange 126 is connected to an upper back rest support 127. The upper U-shaped flange 126 extends substantially the width of the back rest frame 102 and is connected on opposite ends of the flange 126 to the back rest frame 102. The lower flange 128 is connected to a C-shaped lower back rest support 132, which is preferably ergonomically shaped 130. The lower U-shaped flange 128 extends substantially the width of the back rest frame 102 and is connected on opposite ends of the flange 128 to a backward C-shaped lower back rest support 132. On opposite ends of the backward C-shaped lower back rest support 132 is a hinge member 136. Each hinge member 136 is attached to the backward C-shaped lower back rest support 132 on one end 138 and on opposite end 140 to the back end 16 of the seat frame 12. The hinge member 136 pivotably operates to allow the back rest 100 to pivot between a first upright position, shown in FIG. 5, and a substantially reclined second position, shown in FIG. 6. Similarly, the head rest 110 and the upper and lower back rest supports, 127 and 132, include a plurality of parallel members 26. The terminating ends 28 of each parallel member 26 is mounted at fastening locations 30 along the respective head rest 110 and upper and lower back support, 127 and 132. The plurality of parallel members 26 provides a surface for the user to rest their back and head upon.

The lockable gas spring 60 has a first end 62 connected to the bottom portion 108 of the back rest 100 and a second end 64 connected to the base column 48, whereby the movable distance between the first end 62 and the second end 64 of the lockable gas spring 60 moves the back rest 100 between a first upright position and a second reclined position. The lockable gas spring 60 includes a base tube 66 that includes a special piston/valve system (not shown). The piston/valve system separates two pressure chambers within the base tube with a piston member. If the valve is operated it allows the pressurized gas to flow between the two pressure chambers. Releasing the valve blocks the flow of gas locking the piston in place within the gas spring to hold even heavy loads in the desired position. The extension shaft 68 has a first end 70 and a second end 72. Attached to the first end 70 of the extension shaft 68 is a mounting piece 74 connected to the bottom portion 108 of the back rest frame 102, and the second end 72 is movable within the base tube 66 of the lockable gas spring 60 and is operably moving the piston within the base tube. It should be noted, the volume of compressed gas contained in the cylinder portion of the gas spring can be adjusted to make the spring more or less forceful in its movement. It should also be noted that while the preferred embodiment locks the back rest in a fixed position upon release of the valve, the lockable gas spring may be constructed to function as spring member from the set position whereby as the user leans back against the back rest, the back rest may move in an elastic manner to provide additional comfort to the user. The valve mechanism is preferably operable by hand and may include cables levers or the like for ease of access to the user.

Figure 5:
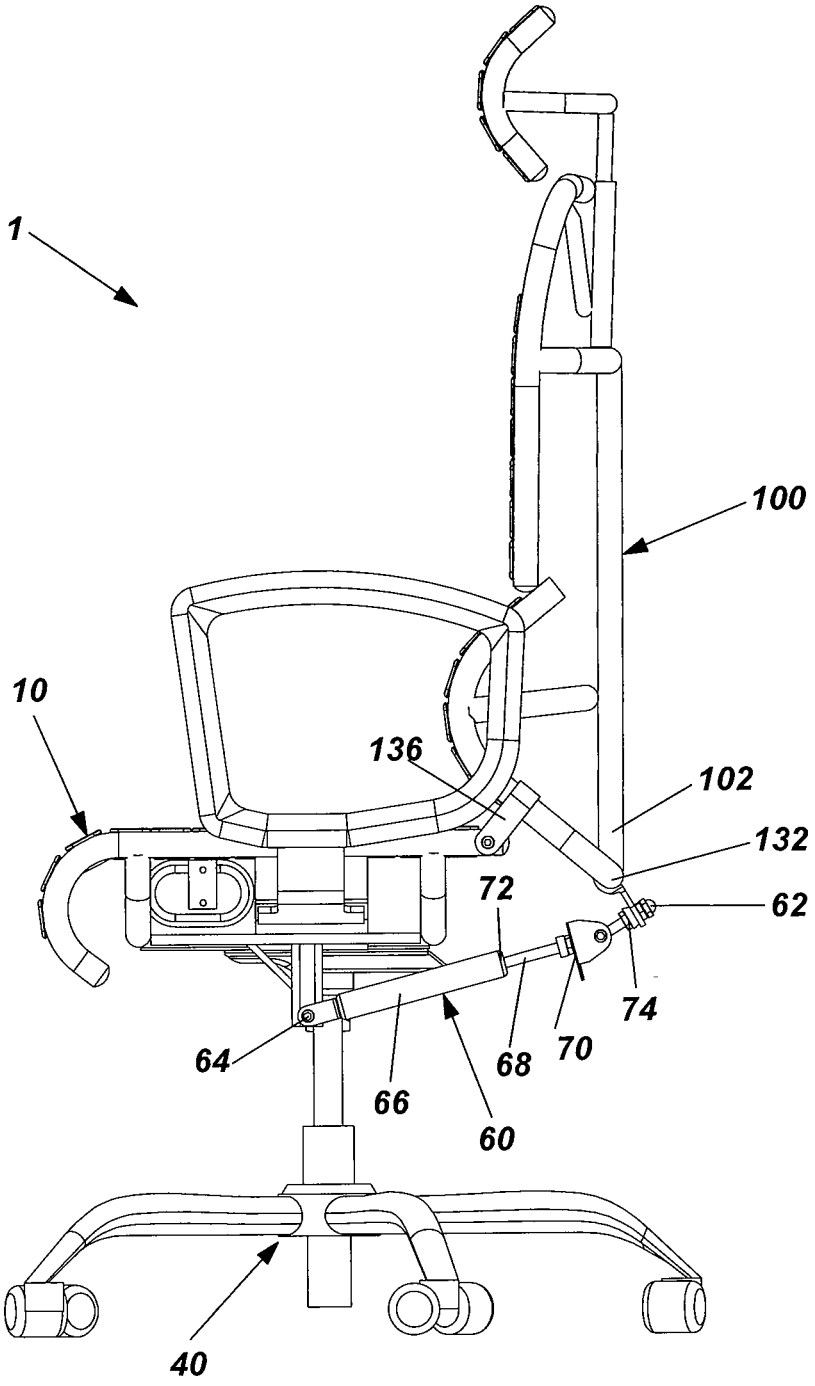
FIG. 5 is a side view in an upright position thereof.
Figure 6:
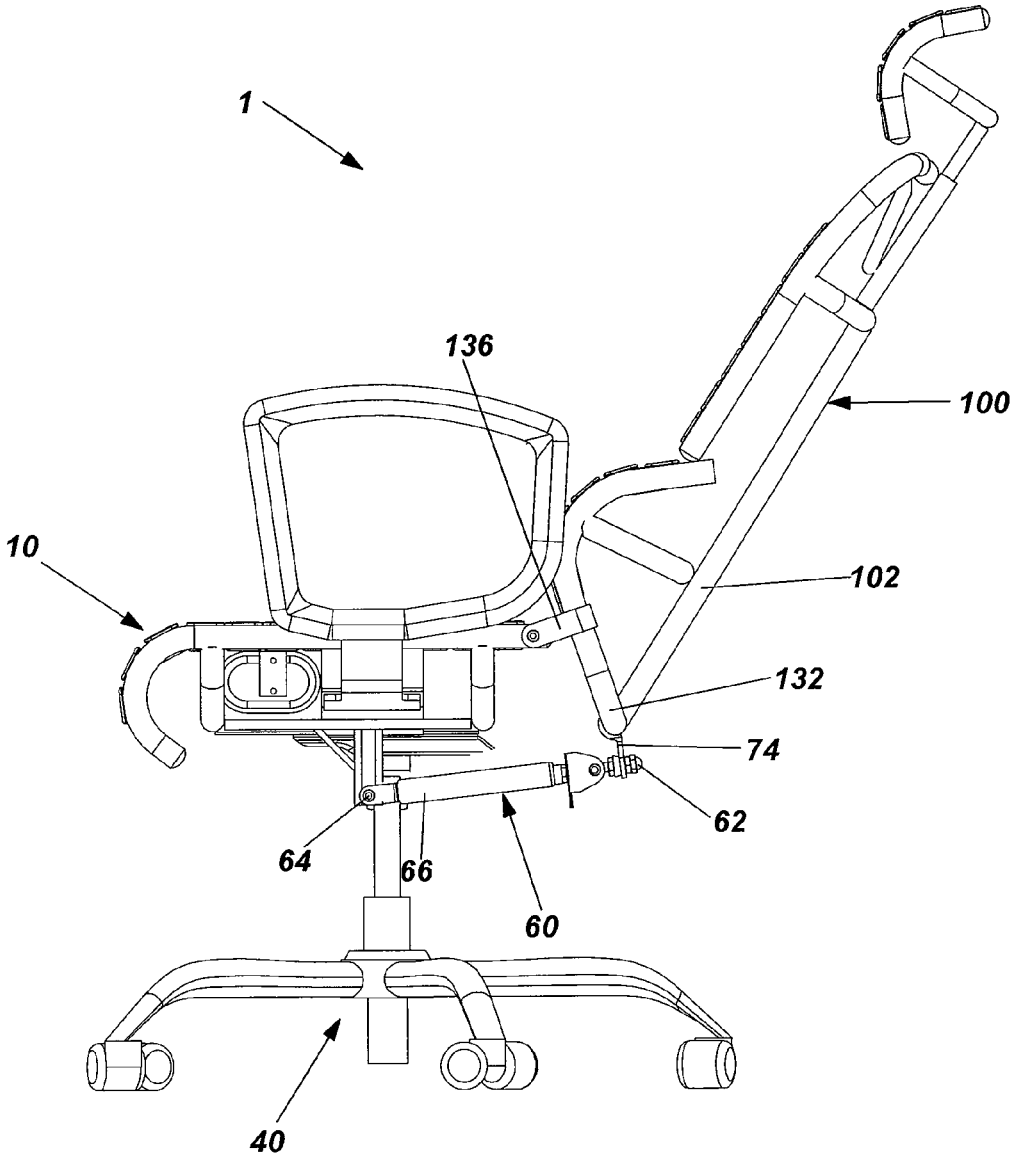
FIG. 6 is a side view in a substantially reclined positioned thereof.

As shown in FIGS. 5 and 6, illustrates one embodiment of the present invention. In this embodiment, the gas spring may not be lockable and may function as free moving gas spring whereby the pressure exerted by the user leaning against the back rest 100 causes the extension shaft 68 to slide within the base tube 66 thereby causing the same movement of the internal piston. The degree of pressure exerted dictates the degree to which the back rest 100 reclines. When the user no longer has his or her full weight on the back rest 100, the back rest 100 automatically returns to the upright position 2 and the extension shaft 68 extends outwards from the base tube 66. The volume of air contained in the base tube 66 can be adjusted to make the extension shaft 68 more or less forceful in its movement, thereby causing an adjustment in the amount of weight or force required by the user to move from the first upright position to the second reclined position.

Referring generally to FIGS. 1-6, the base frame 40, seat 10, and back rest 100 may be constructed of same or different materials. In a preferred embodiment, the components are constructed of a combination of materials such as, but not limited to, a metal, a metal alloys, plastics, wood, fiberglass, composites or a suitable combination thereof. Other useful materials from which to manufacture any of the components of this invention include materials such as, but not limited to, one or more plastics and resins: reinforced plastic, ABS, Polycarbonate, Noryl™, PVC, ABS/PVC, PVC/Acrylic, Polysulfone, Acrylic, Polyethylene, Kydex™, PETG. All of the structural components making up the base frame 40, seat 10, or back rest 100 may be hollow or solid, and assembled from angular, polygon or round tubing.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An office chair with a reclining back rest comprising:

a base frame, said base frame including a plurality of leg members for providing stability to said base frame, a column extending vertically from a central portion of said plurality of leg members;

a seat member fixedly secured to said column, said seat including a front end and a back end;

a back rest, said back rest having a top portion, an intermediate portion, a bottom portion, a cushioned surface for a user to sit against, and a frame having an upper end, an intermediate region, and a lower end, said frame forming the shape of said back rest, said cushioned surface connected to said frame, said lower end of said frame extending back from said cushioned surface and said seat member;

at least one hinge member with a first end and a second end, said first end of said at least one hinge member fixedly secured to said intermediate region of said back rest frame, said second end of said at least one hinge member pivotally connected to back end of said seat member;

a gas spring with a first end and a second end, said gas spring first end pivotally connected to said lower end of said back rest frame and said gas spring second end pivotally connected to said base frame, said gas spring providing biased pivoting to said back rest.

2. The office chair of claim 1 wherein said gas spring is a locking gas spring, whereby said locking gas spring is infinitely positionable within its range of movement.

3. The office chair of claim 2 wherein said locking gas spring includes two separate gas chambers separated by a piston member within a base tube member, a valve assembly fluidly connected to both said gas chambers, said valve assembly constructed and arranged to selectively allow pressurized fluid to flow from one said gas chamber to the other said gas chamber.

4. The office chair of claim 3 wherein said fluid is a gas.

5. The office chair of claim 4 wherein said valve assembly is manually operable, whereby operation of said valve assembly allows said pressurized gas to flow from one said gas chamber to the other said gas chamber and whereby release of said valve assembly blocks the flow of said pressurized gas from one said gas chamber to the other said gas chamber locking said piston in a substantially fixed position.

6. The office chair of claim 1 wherein said gas spring is an elastic locking gas spring, wherein said locking gas spring includes two separate gas chambers separated by a piston member within a base tube member, and a valve assembly fluidly connected to both said gas chambers, said valve assembly constructed and arranged to selectively allow pressurized fluid to flow from one said gas chamber to the other said gas chamber whereby said locking gas spring is infinitely positionable within its range of movement.

7. The office chair of claim 6 wherein said fluid is a gas.

8. The office chair of claim 7 wherein said valve assembly is manually operable, whereby operation of said valve assembly allows said pressurized fluid to flow from one said gas chamber to the other said gas chamber and whereby release of said valve assembly blocks the flow of said pressurized gas from one said gas chamber to the other said gas chamber, said piston elastically positioned in a second position within said base tube member, whereby force exerted against said back rest proportionally moves said piston, said piston returning to said second position upon release of said force.

9. The office chair of claim 1 wherein said column includes a gas lift spring.

10. The office chair of claim 1 wherein each said leg member includes a caster wheel, enabling said office chair to be easily moved.

11. The office chair of claim 1 wherein said gas spring is a free moving gas spring, said locking spring including two separate gas chambers separated by a piston member within a base tube member, whereby a force applied to said back rest causes movement of said piston within said base tube, said back rest automatically returning to a first upright position upon removal of said force.

* * * * *